US006353959B1

(12) United States Patent
Thomas, V

(10) Patent No.: US 6,353,959 B1
(45) Date of Patent: Mar. 12, 2002

(54) TOOTHBRUSH

(76) Inventor: Andrew R. Thomas, V, 1157 St. Matthews Rd., Chester Springs, PA (US) 19425

( * ) Notice: Subject to any disclaimer, the term of this patent is extended or adjusted under 35 U.S.C. 154(b) by 0 days.

(21) Appl. No.: 09/527,606

(22) Filed: Mar. 17, 2000

(51) Int. Cl.[7] ..... A46B 5/02; A46B 9/04
(52) U.S. Cl. ..... 15/167.1; 15/143.1; D4/104
(58) Field of Search ..... 15/143.1, 167.1; D4/104

(56) References Cited

U.S. PATENT DOCUMENTS

| | | | | | |
|---|---|---|---|---|---|
| 2,241,584 | A | * | 5/1941 | Cohen | 15/167.1 X |
| 2,263,885 | A | * | 11/1941 | McGauley | 15/143.1 |
| 2,651,068 | A | * | 9/1953 | Seko | 15/167.1 X |
| 3,010,131 | A | * | 11/1961 | Kisky | 15/167.1 |
| 4,150,457 | A | * | 4/1979 | Larson | 15/167.1 X |
| 4,274,174 | A | * | 6/1981 | Ertel | 15/143.1 |
| D278,662 | S | * | 5/1985 | Fay | D4/104 |
| 4,679,272 | A | * | 7/1987 | Florence | 15/167.1 X |
| 4,679,273 | A | * | 7/1987 | Okin | 15/167.1 |
| 4,729,142 | A | * | 3/1988 | Yoshioka | 15/167.1 |
| 4,738,001 | A | * | 4/1988 | Shipp | 15/167.1 X |
| D296,841 | S | * | 7/1988 | Bushey | D4/104 |
| 4,780,923 | A | * | 11/1988 | Schultheiss | 15/167.1 X |
| D300,990 | S | * | 5/1989 | Jagger | D4/104 |
| 4,882,803 | A | * | 11/1989 | Rogers et al. | 15/167.1 |
| D315,448 | S | * | 3/1991 | Ambasz | D4/104 |
| 5,365,881 | A | * | 11/1994 | Spora | 15/143.1 X |
| D358,206 | S | * | 5/1995 | Smith | D4/104 |

FOREIGN PATENT DOCUMENTS

| | | | | |
|---|---|---|---|---|
| CH | 179733 | * | 12/1935 | 15/167.1 |
| GB | 2208470 | * | 4/1989 | 15/167.1 |
| WO | 91/07114 | * | 5/1991 | 15/167.1 |
| WO | 94/09678 | * | 5/1994 | 15/167.1 |

* cited by examiner

*Primary Examiner*—Mark Spisich
(74) *Attorney, Agent, or Firm*—Zachary T. Wobensmith, III

(57) ABSTRACT

A toothbrush that is suitable for an individual to use to brush the teeth and gums of another, and which is also suitable to brush his or her own teeth and gums. The toothbrush includes a cylindrical handle with an attached neck, and an oval shaped bristle head extending from the neck, at an angle in the range of 142 to 155 degrees, with the handle having an upper indentation to engage the index finger of the user, and a lower indentation for engagement by the thumb of the user, the toothbrush being useful for either hand of the user.

3 Claims, 2 Drawing Sheets

TOOTHBRUSH

BACKGROUND OF THE INVENTION

1. Field of the Invention

This invention relates to a toothbrush for cleaning teeth and gums, which can be used by a person to clean the teeth of another, or can be used by anyone to clean his or her teeth. The toothbrush includes a handle, a neck and a bristle head, which is angled from the neck, and which toothbrush has provisions to improve its handling characteristics's and efficiency.

2. Description of the Prior Art

One of the most important factors in promoting good dental hygiene, and preventing damage to teeth and gums, is in starting a child in early brushing of his or her teeth. Young children may be incapable of properly brushing their own teeth, and the task falls on the parents. No satisfactory toothbrush is known that permits an individual, such as a parent, to effectively brush a child's teeth, and then the child to be able to use the same toothbrush to brush his or her teeth when he or she can properly manipulate the toothbrush.

There have been many attempts to provide toothbrushes which are supposed to more efficiently or easily clean teeth. Such toothbrushes use various angles for the head in relation to the handle, have fluted or shaped handles and various configurations of brush heads.

Examples of such toothbrushes are shown in the U.S. Patents to VEO U.S. Pat. No. Des. 136,042, Kreuger U.S. Pat. No. Des. 175,894 Endo U.S. Pat. No. Des. 296,270, Bushey U.S. Pat. No. Des. 296,841; Jagger U.S. Pat. No. Des. 300,990; Smith U.S. Pat. No. Des. 358,206; Cohen U.S. Pat. No. 2,241,584; Seko U.S. Pat. No. 2,651,068; Gracian U.S. Pat. No. 2,978,724; Okin U.S. Pat. No. 4,679,273; Hansen et al U.S. Pat. No. 4,780,924; and Key U.S. Pat. No. 5,371,915.

While these toothbrushes may be suitable for their intended purpose, none of them is suitable for use both in assisting or cleaning the teeth of another, such as a young child, and by an individual on his or her own teeth.

The toothbrush of the invention fulfills both roles and provides many other advantages.

SUMMARY OF THE INVENTION

This invention relates to a toothbrush that is suitable for use by an individual in brushing another's teeth, and is also useful by an individual in brushing his or her own teeth. The toothbrush includes a handle, a neck and a bristle head which is at an angle to the neck. The handle has indentations to permit the fingers of the user to more easily grip and guide the brush, and the bristlehead is an oval rounded head with bristles therein.

The principal object of the invention is to provide a toothbrush that is useful for both an individual brushing the teeth of another, and also for brushing his or her own teeth.

A further object of the invention is to provide a toothbrush that can be held in either of the users hands.

A further object of the invention is to provide a toothbrush that comfortably moves throughout the mouth, thereby facilitating effective brushing as a person uses the brush to clean the teeth and gums of another.

A further object of the invention is to provide a toothbrush that is simple and inexpensive to construct, but sturdy and long lasting in use.

A further object of the invention is to provide a toothbrush that provides for ease of handling.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1, 2, 4 and 5 of the drawings, one embodiment of the toothbrush 10 of the invention is therein illustrated which is of adult size. The toothbrush 10 includes a handle 11, which is preferably formed of molded plastic.

The handle 11 is of cylindrical configuration, with a neck 12 joined thereto at its lower end 14.

Figure 1:
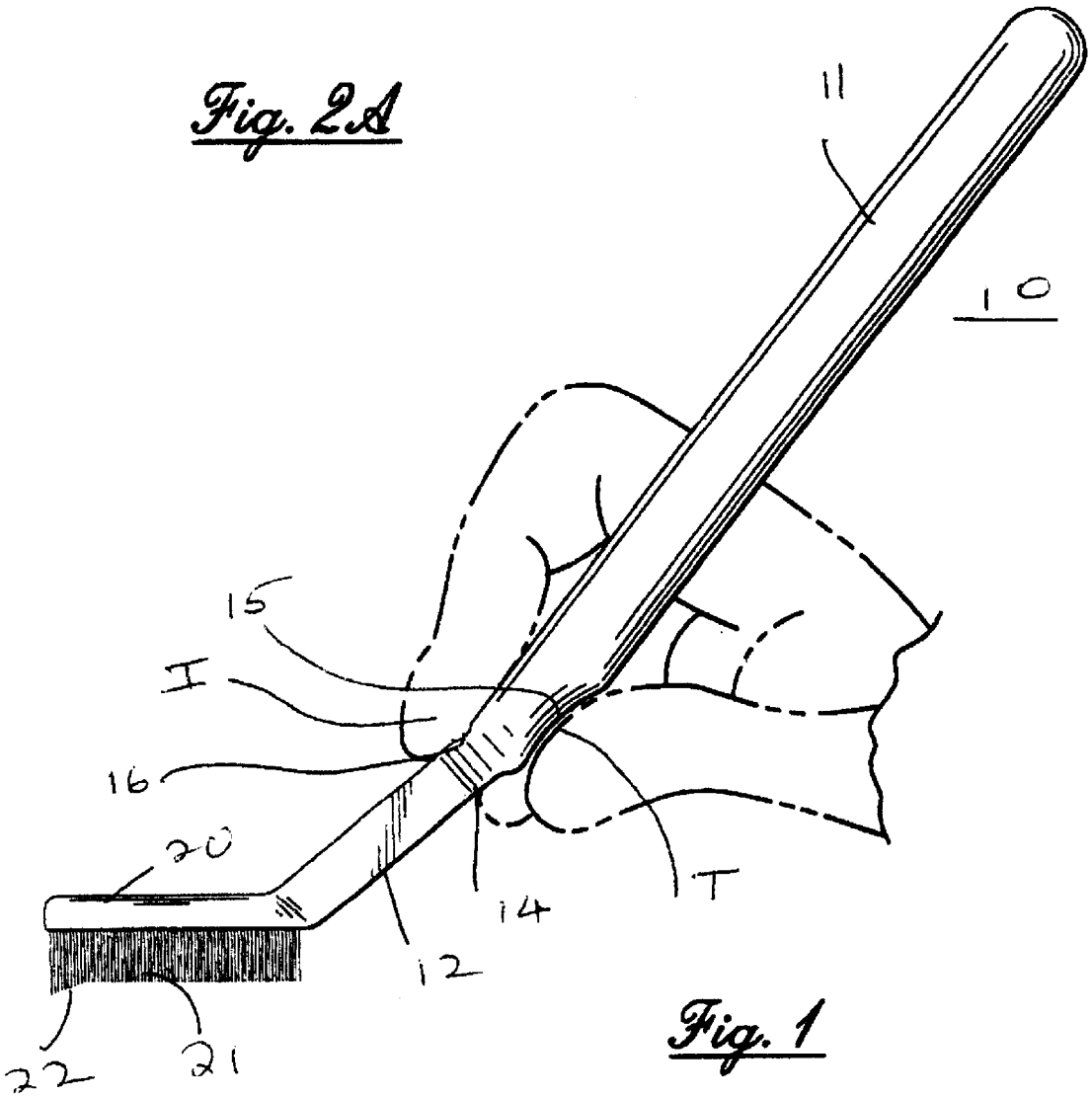
FIG. 1 is a side elevational view of the toothbrush of the invention, with a fragmentary portion of a hand in contact therewith.

Adjacent the end 14 of handle 11, a lower indentation 15 is provided, set back from the end 14, which as illustrated in FIG. 1 is intended to accommodate the thumb T of a user (not shown).

The handle 11 has an upper indentation 16 formed by the angle between end 14 of handle 11, and the neck 12, for engagement by the index finger I of a user (not shown). The angle between the neck 12 and handle 11 is approximately 13 degrees.

A bristle head 20 is provided, integral with and at an angle to the neck 12. In a preferred embodiment the head 20 has a plurality of bristles 21 or well known type, preferably of nylon, and with the front most bristles 22 of greater increasing length as shown in the Figs. The angle between the head 20 and neck 12 can vary with the minimum preferred angle of 142 degrees shown in FIG. 4, and the maximum preferred angle of 155 degrees shown in FIG. 5.

Figure 2:
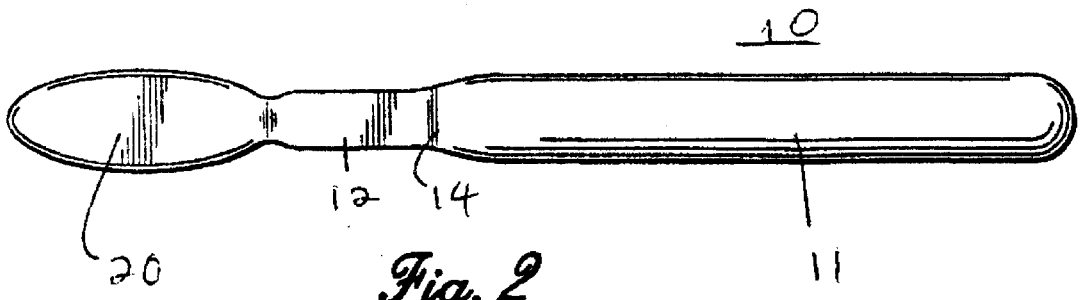
FIG. 2 is a top plan view of the toothbrush of FIG. 1.

The bristle head 20 as shown in FIG. 2 is of an oval tear drop configuration, and the neck 12 is of a rectangular configuration, and narrower than handle 11.

The preferred dimensions of the older child/adult sized toothbrush are that the handle 11 is of 1⅜ inch circumference, with a length of 4½ inches; the neck 12 is of ⅞ inch circumference, with a length of 1⅜ inches; and the bristle head is of 1 inch length, ⅜ inch width and ⅛ inch height.

The toothbrush 10 of FIGS. 1, 2, 4 and 5 is designed for use in an older child/adult sized mouth.

Figure 2A:
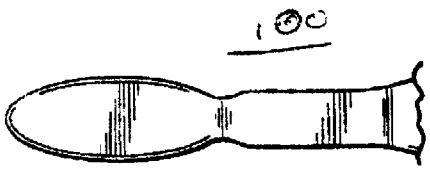
FIG. 2*a* is a fragmentary top plan view of a Pediatric size bristle head, of the toothbrush of the invention.
Figure 3:
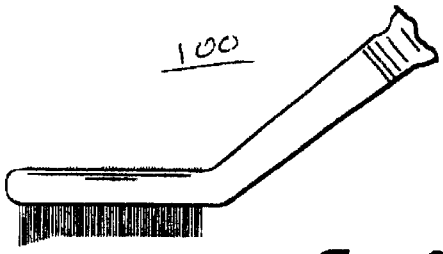
FIG. 3 is a fragmentary, side elevational view of the toothbrush of FIG. 2A.
Figure 4:
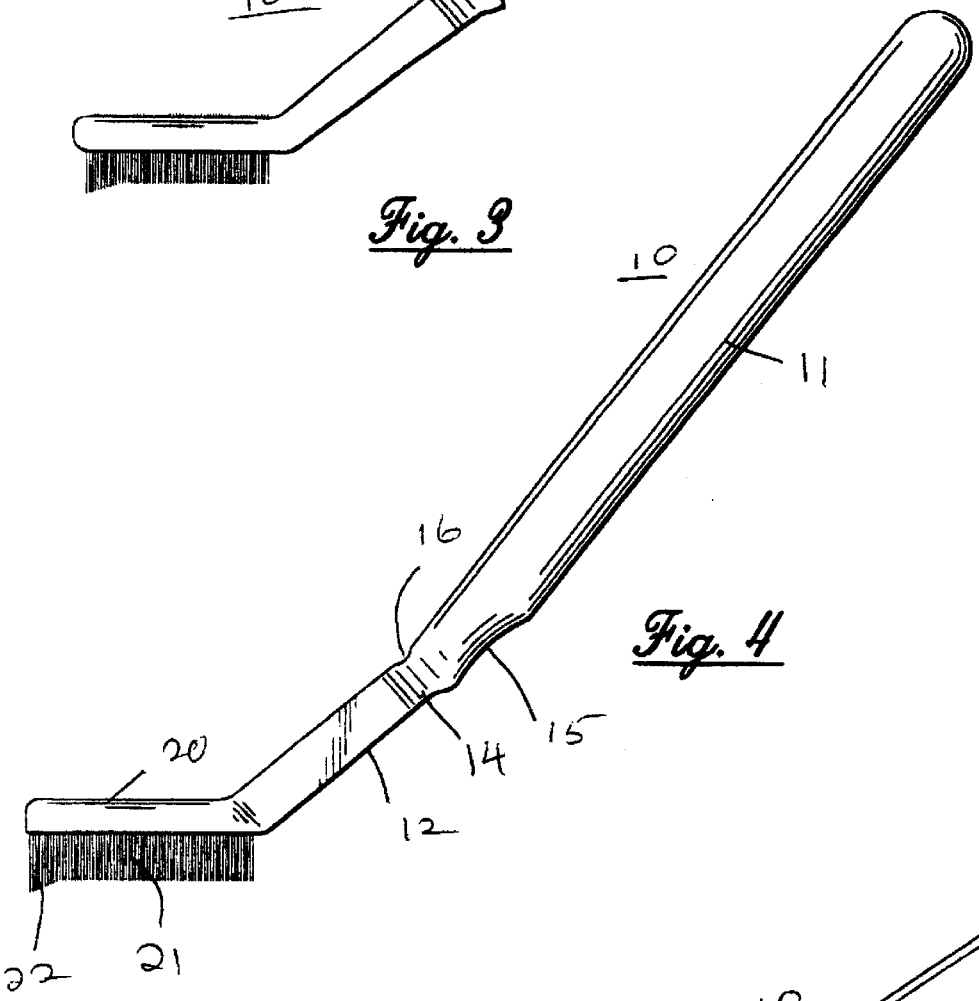
FIG. 4 is a side elevational view of the toothbrush of FIG. 1, with the bristle head at the minimum preferred angle to the handle.
Figure 5:
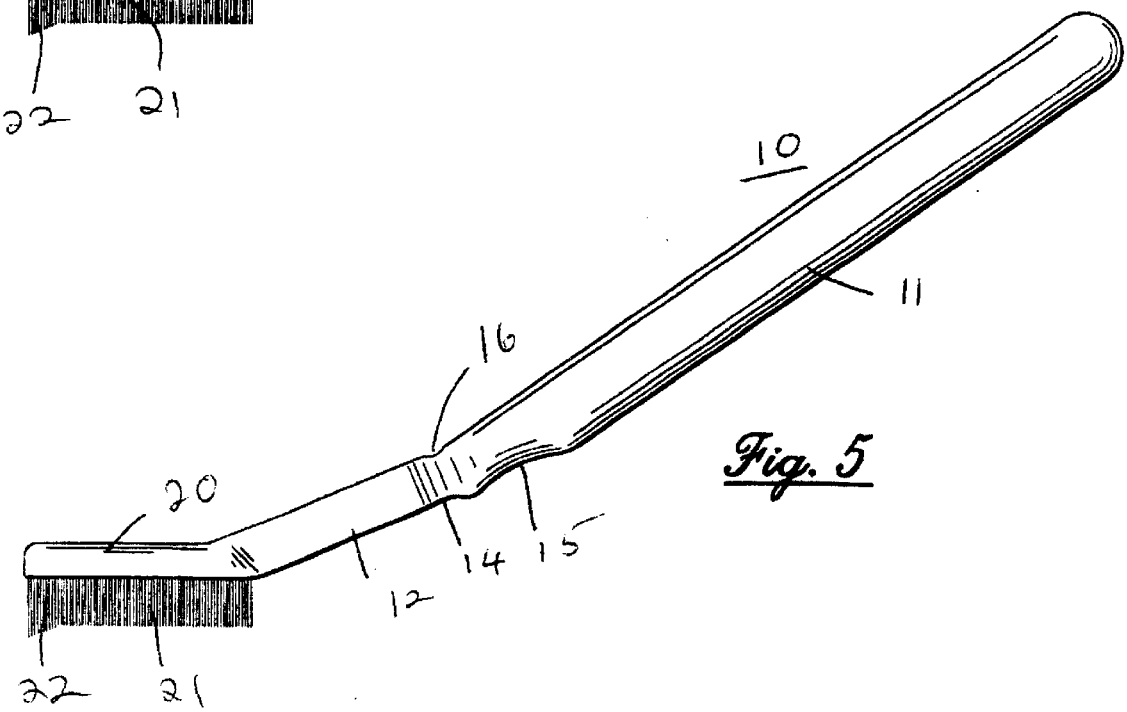
FIG. 5 is a view similar to FIG. 4 with the bristle head at the maximum preferred angle to the handle.

A toothbrush 100 is illustrated in FIGS. 2A and 3, which is of the same configuration as the toothbrush 10 of FIG. 1, and intended for use as a pediatric toothbrush, with certain dimensions accordingly reduced to be useful in a baby or small child-sized mouth.

The mode of operation and use will now be pointed out.

To use the toothbrush 10 the user grasps the handle 11 as you would grip a writing instrument, with the thumb T in indentation 15, and the index finger I in indentation 16, and applies the bristles 21 and 22 to the teeth to be brushed. The toothbrush 10 can be held in either the right or left hand of the user, and can be applied to his or her own teeth or to the teeth of another.

It will thus be seen that a toothbrush has been provided with which the objects of the invention are achieved.

I claim:

1. A toothbrush for cleaning teeth and gums particularly of another person, which includes a handle, a bristle head with a plurality of bristles, and a neck connecting said handle to said bristle head wherein:

said neck is angled to said handle at an angle of approximately 13 degrees, said bristle head is angled to said neck at an angle in the range of 142 to 155 degrees, said plurality of bristles form a generally linear surface with the front most bristles of increasing length, forming an angle with the remainder of the bristles, said handle is of round configuration, and an upper and a lower indentation are provided in said handle adjacent said neck to accommodate the index finger and thumb of a user.

2. A toothbrush as defined in claim 1 in which said bristle head is of oval teardrop configuration.

3. A toothbrush as defined in claim 1 wherein:

said handle, said bristle head and said neck are of molded plastic.

* * * * *